United States Patent [19]

Saurwein

[11] 4,264,257

[45] Apr. 28, 1981

[54] AUTOMATED PARKING SYSTEM AND SUBASSEMBLIES THEREFOR

[75] Inventor: Albert C. Saurwein, Seattle, Wash.

[73] Assignee: Venus Products, Inc., Kent, Wash.

[21] Appl. No.: 57,813

[22] Filed: Jul. 16, 1979

[51] Int. Cl.[3] ..... E04H 6/22

[52] U.S. Cl. ..... 414/259; 414/253; 414/263

[58] Field of Search ..... 414/228, 241–246, 414/253–256, 259–261, 263

[56] References Cited

U.S. PATENT DOCUMENTS

| | | | |
|---|---|---|---|
| 2,691,448 | 10/1954 | Lontz | 414/263 X |
| 3,439,815 | 4/1969 | Wagner et al. | 414/263 X |
| 3,497,087 | 2/1970 | Vita | 414/254 X |

*Primary Examiner*—Jeffrey V. Nase

*Attorney, Agent, or Firm*—Christensen, O'Connor, Johnson & Kindness

[57] ABSTRACT

An automated parking system includes a multi-story tower having a central elevator shaft. The building is substantially circular in cross section and contains a plurality of parking stalls that radiate from the elevator shaft on each of the stories. An elevator mechanism elevates a turntable, rotatably mounted on the elevator mechanism for rotation about a substantially vertical axis, between the several floors of the building. A shuttle travels from the turntable to an entrance ramp on the ground level of the building, moves a vehicle to be parked from the entrance ramp to the turntable, whereupon the elevator and turntable cooperate to deposit the vehicle in a parking stall on one of the several floors. The elevator and turntable mechanism operate in reverse to carry the vehicle from a parking stall to an exit ramp on the groung floor of the building.

3 Claims, 11 Drawing Figures

AUTOMATED PARKING SYSTEM AND SUBASSEMBLIES THEREFOR

BACKGROUND OF THE INVENTION

The present invention relates to a space-saving, automated parking system, and several subassemblies therefor, including a shuttle mechanism for picking up a vehicle and transferring it from a parking stall to a turntable mechanism, a device associated with the shuttle for extending its reach into a parking stall and thereby reducing the overall required diameter of the building, and mechanism for feeding hydraulic and electrical lines to a shuttle as it moves on and off a turntable.

Parking and storage space for vehicles, especially automobiles, has become scarce in urban areas and is at a premium especially in city center areas where high density shopping and business buildings are located. Additionally, parking space is becoming expensive to provide even in suburban or regional shopping centers where land prices adjacent such shopping centers are ever constantly escalating.

It is accordingly a broad object of the present invention to provide a vehicle parking and storage system that requires a minimum of group space, thereby reducing the cost of land for the parking and storage system and allowing land that would otherwise be utilized for parking and storage of vehicles to be more gainfully and profitably used as commerical or residential centers. It is another broad object of the present invention to provide a multi-story parking tower whereby vehicles left by their owners at a ground floor are automatically received, parked and stored, and retrieved. It is still a further object of the present invention to provide such a multi-story vehicle parking and storage tower that utilizes a minimum of mechanism so that the system can be built reasonably economically, and so that maximum parking and retrieval speeds of on the order of one minute or less can be achieved for each vehicle.

SUMMARY OF THE INVENTION

In accordance with the foregoing objects, and other broad and more particular objects that will become apparent to one of ordinary skill in the art after reading the foregoing specification, the present invention provides a shuttle assembly is provided for an automated parking system. The shuttle assembly includes a vehicle transfer means for carrying a vehicle from a first vehicle receiving stall to a second receiving stall. This vehicle transfer means can of course be a turntable and elevator mechanism for carrying vehicles among several stories of a parking tower each of which contains a plurality of vehicle receiving stalls. A shuttle means is associated with the vehicle transfer means and the vehicle receiving stalls for transferring a vehicle between the vehicle transfer means and the stalls. The shuttle means is mounted for reciprocation along a substantially linear path as it moves between the vehicle transfer means and the vehicle receiving stalls. A power means is provided for reciprocating the shuttle means, which power means includes a flexible member tethering the shuttle means to the vehicle transfer means. An extensible means is associated with the flexible member for extending the travel of the shuttle means into the stalls, and thereby increasing the length of the path along which the shuttle means reciprocates. More importantly, however, by increasing the length of the path of travel, the overall width or diameter of the turntable can be reduced, thereby reducing the overall area necessary to house the vehicle transfer means and shuttle means.

BRIEF DESCRIPTION OF THE DRAWINGS

A better understanding of the present invention can be derived by reading the ensuing specification in conjunction with the accompanying drawings wherein.

DETAILED DESCRIPTION OF THE INVENTION

Figure 1:
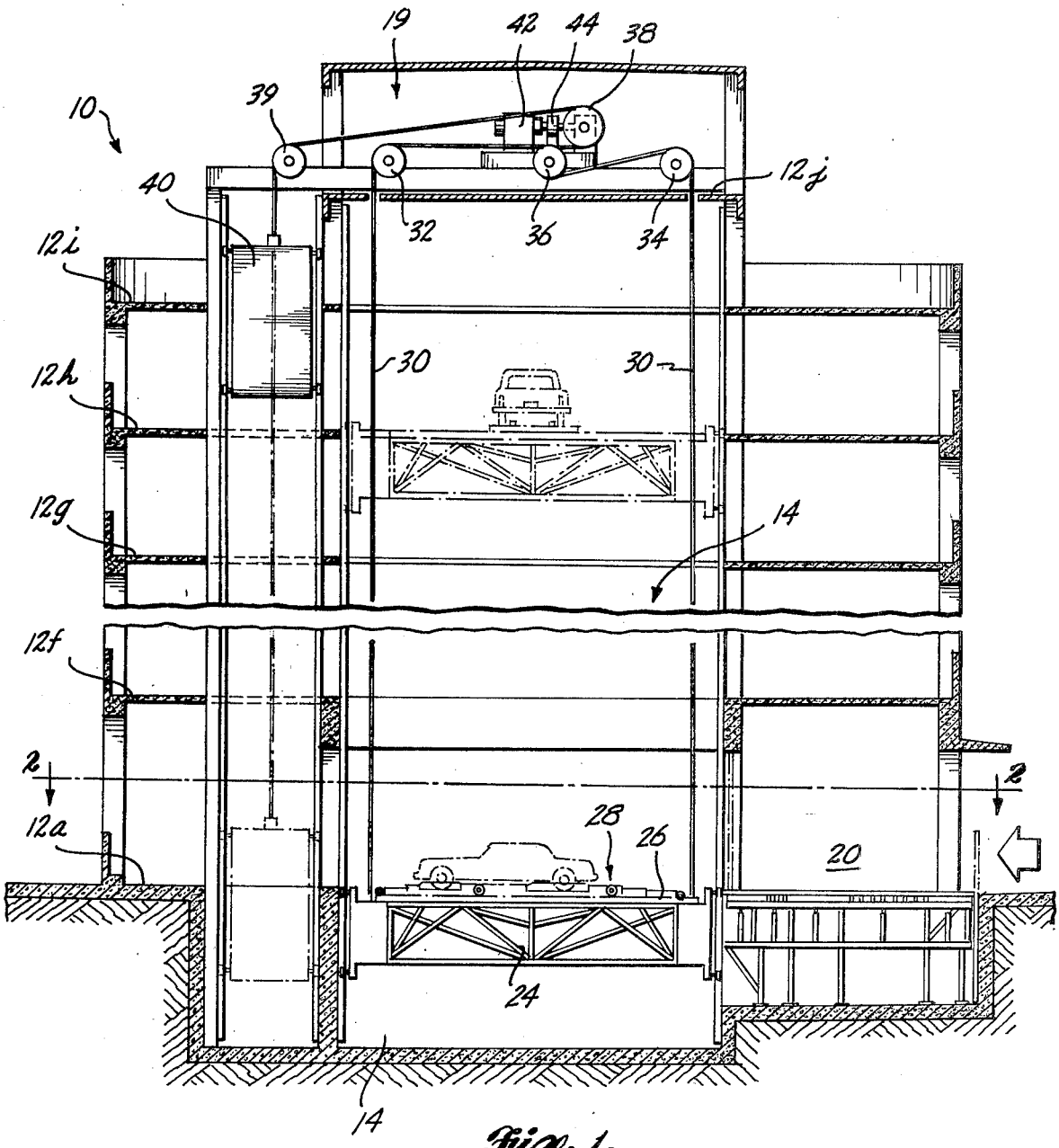
FIG. 1 is a vertical sectional view of the parking tower of the present invention.

Referring first to FIG. 1, a mutli-story building 10 is illustrated as being segmented to omit the center portion and thus eliminate the necessity of showing more than the ground floor and three complete upper floors. The building can contain as many stories as desired; however, it is preferred to limit the number of stories to twenty or less. Referring now conjunctively to FIGS. 1 and 2, the building 10 comprises a ground floor **12*a* and upper stories 12*f*, 12*g*, 12*h* and 12*i* as well as a penthouse story 12*j*. The building 10 has a generally circularly shaped cross section with a central elevator well or shaft 14 situated concentrically within the building. Radiating from the elevator shaft 14 on each story are a plurality of parking stalls 16*a*, 16*b*, 16*c*, 16*d*, 16*e*, 16*f* and on ground level 12*a* for example and 18*a* through 18*h* on for example, level 12*g*. Each of the floors above the ground floor 12*a*, with the exception of the penthouse story 12*j* has ten parking stalls radiating from the shaft 14 in an annular array. The penthouse story 12*j* houses the elevator lift mechanism generally designated 19 in FIG. 1 and other mechanical equipment. The ground story 12*a* contains seven parking stalls, an entrance port or ramp 20 and an exit port or ramp 22. Situated between the exit ramp and the entrance ramp is an office facility 23 (shown in FIG. 2). The office 2** is where a patron of the parking tower receives his parking receipt upon entering the building with his vehicle and pays his parking fee upon retrieving his vehicle. Furthermore, the office can hold the equipment for controlling the operation of the system.

Situated in the elevator shaft 14 is an elevator platofrm 24. A turntable 26 is mounted for rotation on the platform 24 about a vertical axis located centrally of the platform and the elevator shaft 14. A shuttle 28 is mounted for reciprocating movement on and off the turntable 26, as shown in FIG. 1. The shuttle 28, omitted for clarity from FIG. 2, will be described in more detail later in the specification. The elevator platform 24 is suspended in a conventional manner by elevator cables 30, which traverse sheaves 32 and 34, a reversing sheave 36, a drive wheel 38 and suspension sheave 39, all conventionally mounted on the penthouse level **12*j*. The cables then extend to a counterweight 40. The drive wheel 38 is driven in a conventional manner by an electric motor 42 which runs through a gear reduction train 44**.

In operation, the owner of a vehicle drives it into the entrance ramp 20 to the parking tower 10. The owner sets the brakes on the car, takes his key and leaves the vehicle in the entrance ramp. The elevator then brings the turntable 26 down to the ground level **12*a*. The shuttle 28 moves from the turntable 26 under the floor of the entrance ramp 20, picks up the vehicle and shifts the vehicle (shown in dotted outline) onto the turntable 26. The turntable then rotates to orient the car axially with an available parking stall on one of the floors; simultaneously, the elevator if necessary, elevates the turntable 26 to a floor containing an available parking stall. For example, the elevator could be carrying the turntable 26 to the floor 12*h* while the turntable is being turned to orient the vehicle toward an appropriate stall on level 12*h*, (all as illustrated in dotted outline adjacent level 12*h* in FIG. 1). Vice versa, the turntable, elevator and shuttle can operate to retrieve a car from one of the parking stalls in the several stories of the building and return it to the exit ramp 22, which is constructed very similarly to the entrance ramp 20**.

Figure 3:
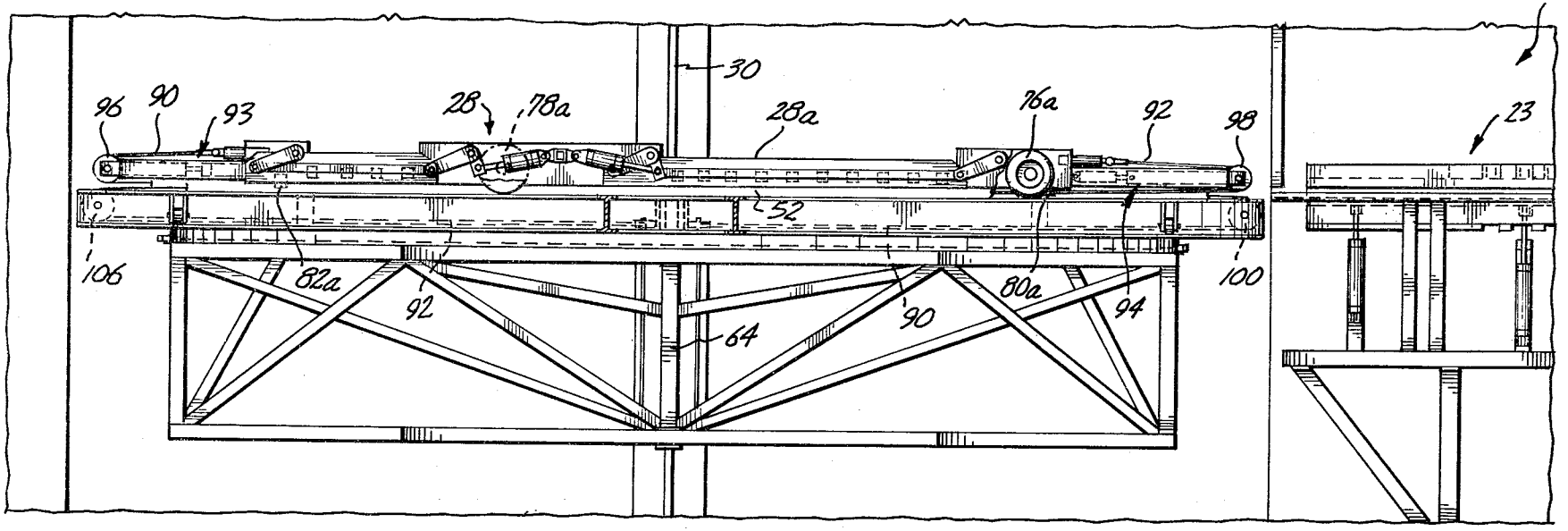
FIG. 3 is an elevation view in partial section of the elevator platform, the turntable and the shuttle assembly illustrating the shuttle poised for movement from the turntable to the receiving entrance ramp.
Figures 7, 7A:
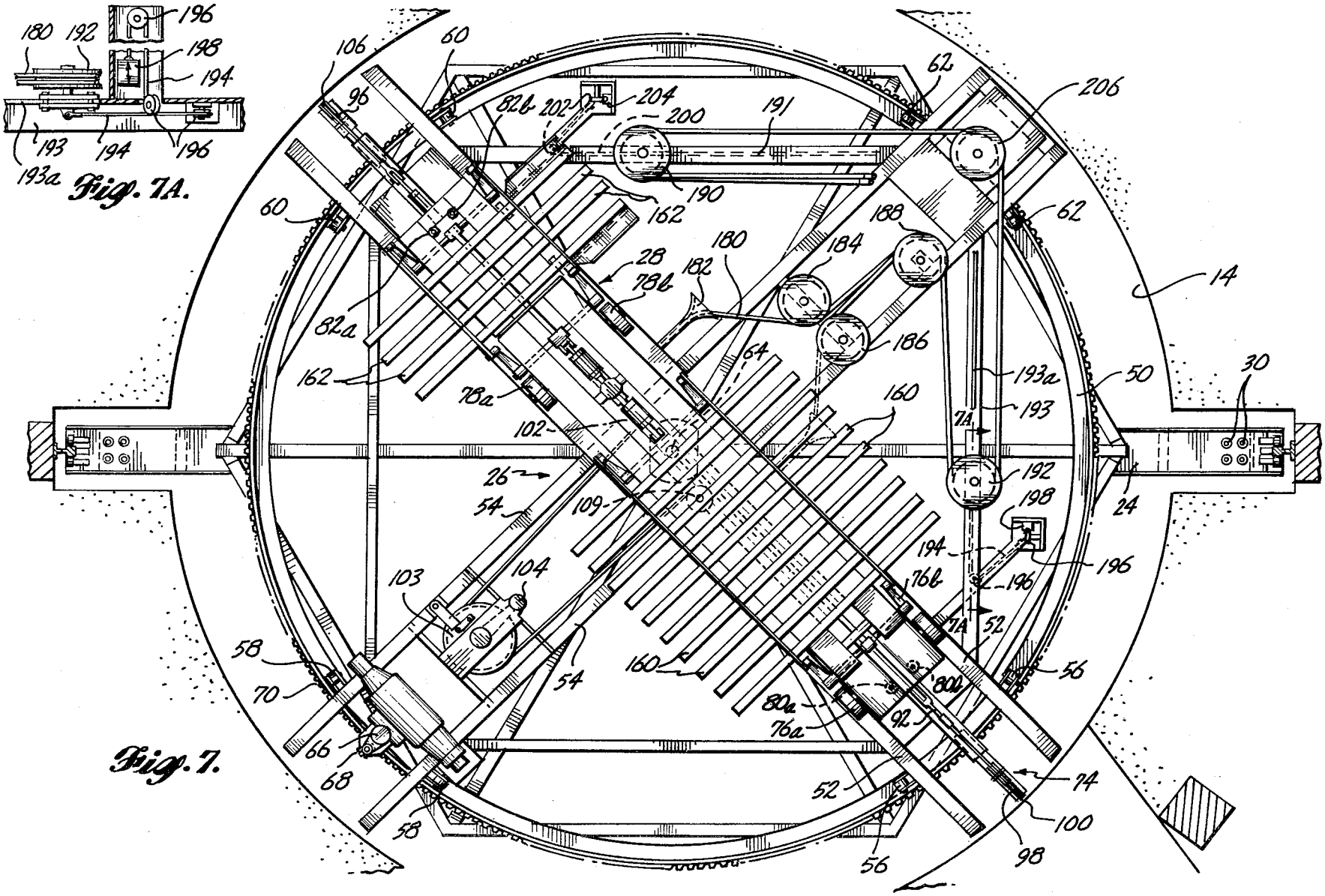
FIG. 7 is an enlarged plan view of the turntable showing the hydraulic line takeup spools; and FIG. **7*a* is a cross-sectional view taken along section line 7A—7A of FIG. 7**.

Referring now to FIGS. 3 and 7, the shuttle 28 is illustrated positioned on the turntable 26. The elevator 24 has an upper circular track 50 that carries and supports the turntable 26. The frame of the turntable 26 is comprised of two pairs of supporting rails 52 and 54 which are oriented at 90 degrees to each other. The ends of each of the pairs of rails 52 and 54 carry wheel sets 56, 58, 60, and 62 which support the turntable 26 for rotational movement on the circular elevator rail 50. A central turntable shaft 64 mounted in suitable bearings on the turntable extends down to the elevator and thus centers the turntable on the elevator 24. The turntable 26 is driven in its rotational movement via a hydraulic motor 66 coupled through a suitable drive train to a pinion gear 68. The pinion gear engages a bull gear 70 on the periphery of the circular turntable rail 50. The hydraulic motor 66 selectively and reversibly drives the pinion gear 68 to rotate the turntable 26 in both the clockwise and counterclockwise direction. A shuttle guide rail 74 is centrally located between and parallel to the pairs of rails 52.

The shuttle, 28 is supported by four wheels **76*a* and *b* and 78*a*, and *b*. The pairs of wheels rest for rolling movement on the rail pairs 52, that is, wheels 76*a* and 78*a* ride on one beam 52 while the other wheels 76*b* and 78*b* ride on the other rail 52. The wheels 76 and 78 are affixed to a central shuttle frame 28*a*. Guide rollers 80*a* and *b* are affixed to and adjacent one end of the shuttle for rotation about a vertical axis relative to frame 28*a* and are spaced laterally relative to the shuttle frame so that they are situated on each side of the shuttle guide rail 74. Similarly, the rollers 82*a* and *b* are situated for rotation about a vertical axis and affixed to the shuttle frame 28*a* adjacent the end of the shuttle opposite the end to which rollers 80*a* and 80*b* are affixed. The rollers 82*a* and *b* are also spaced so that they are situated on each side of the guide rail 74. Thus as the shuttle moves longitudinally relative to the guide rail, the guide rollers 80*a* and *b* and 82*a* and *b*** maintain the shuttle in a straight line path.

Referring briefly back to FIG. 2, each of the parking stalls, for example **16*b* also contains a central shuttle guide rail 86 that is longitudinally aligned with the turntable guide rail 74 when the turntable is oriented to transfer a vehicle into or from the stall. Thus as the shuttle travels from turntable 26, the wheels are supported by the floor of the parking stall and the shuttle is guided for linear movement via the rail 86** and other similar rails in each of the parking stalls.

Still referring to FIGS. 3 and 7, the drive mechanism for the shuttle 28 includes a pair of cable halves 90 and 92 having their ends affixed to opposite ends of the shuttle frame **28*a* above telescoping frame extensions 93 and 94 of the shuttle. The outermost end of each of the telescoping extensions 93 and 94 carry sheaves 96 and 98 that are mounted on the telescoping ends of the assemblies 93 and 94 for rotational movement in the vertical planes. The cables 90 and 92 engage the sheaves and are wrapped 180 degrees about the sheaves so that each one extends in opposite directions under the carriage frame 28*a*. The cable 90 then extends to an opposite end of the rail 74 where a sheave 100 is also mounted for rotation in the vertical plane between the turntable frame rails 52. The cable 90 traverses the sheave 100 for 180 degrees and then extends back toward the center of the turntable where it traverses another sheave 102 mounted for rotation in a horizontal plane between two frame rails 52. From there the cable 90 is wrapped about a drum 103 which in turn is driven by a hydraulic motor 104 through a suitable gear train. The opposite cable 92 traverses the sheave 98 for 180 degrees, extends under the shuttle frame 28*a* and traverses a sheave 106 at the opposite end of the guide rail 74 from sheave 100. The cable 92 traverses another sheave 109 adjacent to and similar to sheave 102, from whence the cable half 92 also engages the drum 103 and is wrapped about the same in the opposite direction. Cable halves 90 and 92 are wrapped a plurality of times about on the drum 103 and can have their ends joined on the drum 103 so that cable halves 90 and 92 in actuality function as an endless unit. Thus by selectively and reversibly rotating drum 103 the shuttle assembly can be driven in either direction along the guide rail 74 and in fact can be driven off by turntable so that for example, the end of the shuttle carrying sheaves 96 can be positioned substantially above the edge of the turntable carrying sheave 100**.

Figure 3A:
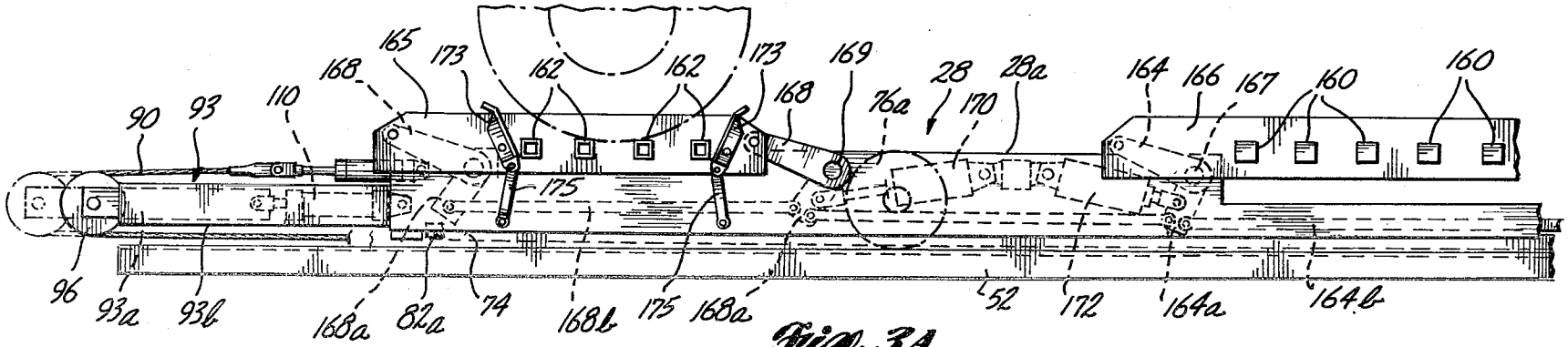
FIG. 3A is an enlarged view of the shuttle resting on the turntable.

In order to extend the shuttle 28 further into a given parking stall along its linear reciprocation path, the telescoping end sections are employed. Referring to FIG. 3A, the telescoping end section 93 comprises an inner member **93*a* and an outer end portion 93*b* that forms an extension of one end of the shuttle frame 28*a*. A hydraulic piston and cylinder assembly 110 is coupled between the inner section 92*a* and the end of the shuttle frame 28** and is housed within the outer section 92*b*. Upon linear extension of the hydraulic piston and cylinder assembly 110, the inner section 92*a*, and thus the sheave 96, is moved longitudinally outwardly relative to the frame 28*a*. As this occurs, since the cable 90 is stationary, the shuttle frame 28*a* is moved to the right further along its reciprocation path. The telescoping section 94 on the opposite end of the shuttle 28 is the mirror image of the telescoping section 93 and operates in an identical manner. By so providing the telescoping, linearly extensible end portions 93 and 94 on each side of the shuttle 28*a*, the shuttle can be made to extend further away from the turntable when being positioned in an entrance or exit ramp or parking stall. Thus the overall length of the suttle can be decreased. Since the overall length of the shuttle is decreased, by the extensible end portions 93 and 94, the necessary overall diameter of the turntable is decreased. Since the overall diameter of the turntable can be decreased so can the diameter of the elevator shaft and thus the diameter of the entire building. Since it can be seen that if, for example, four feet of shuttle length and thus overall length are saved, a substantial amount of floor area when calculated at the periphery of the building is saved, thus saving on overall cost and space utilization.

Figure 5:
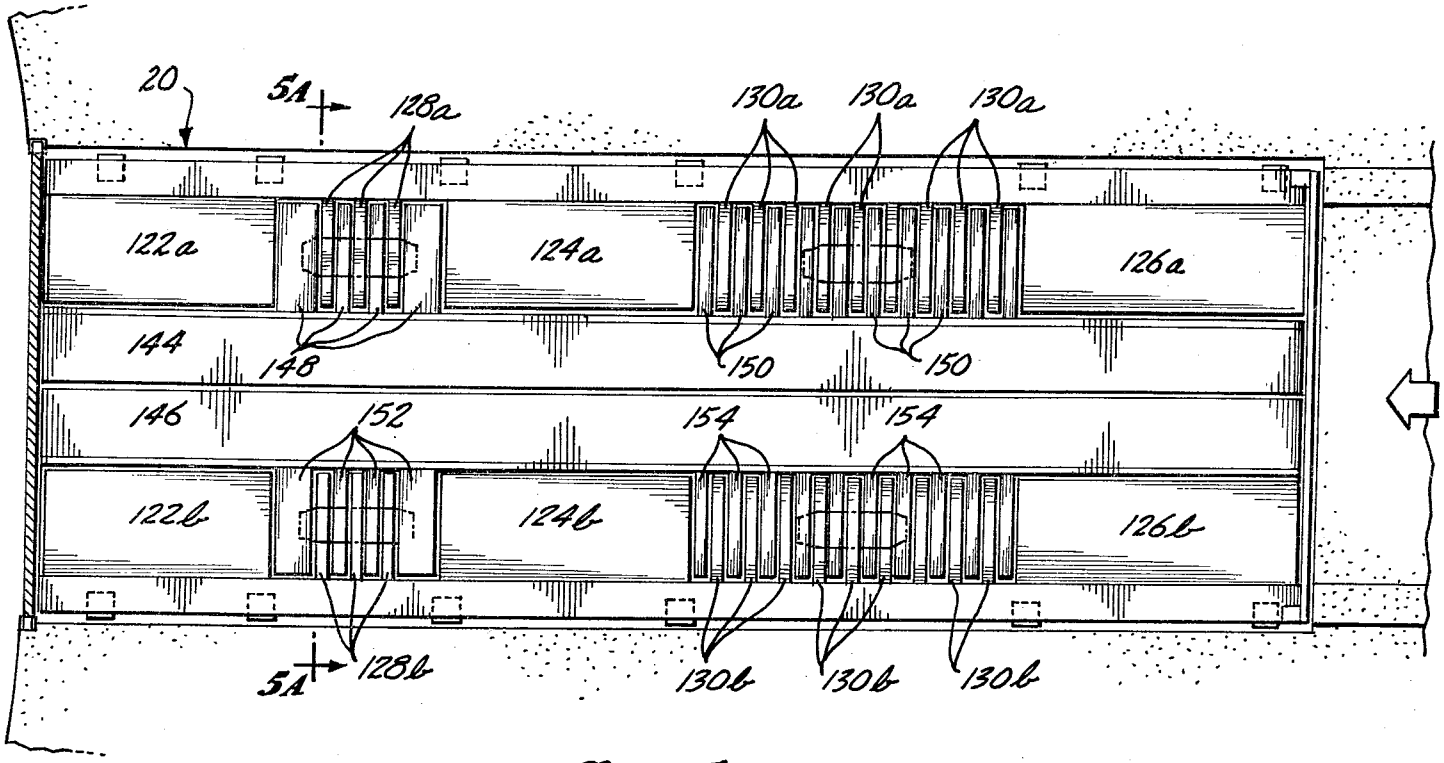
FIG. 5 is a plan view of the entrance ramp showing the filler plate and fingers in an up position to form a substantially continuous platform.
Figure 5A:
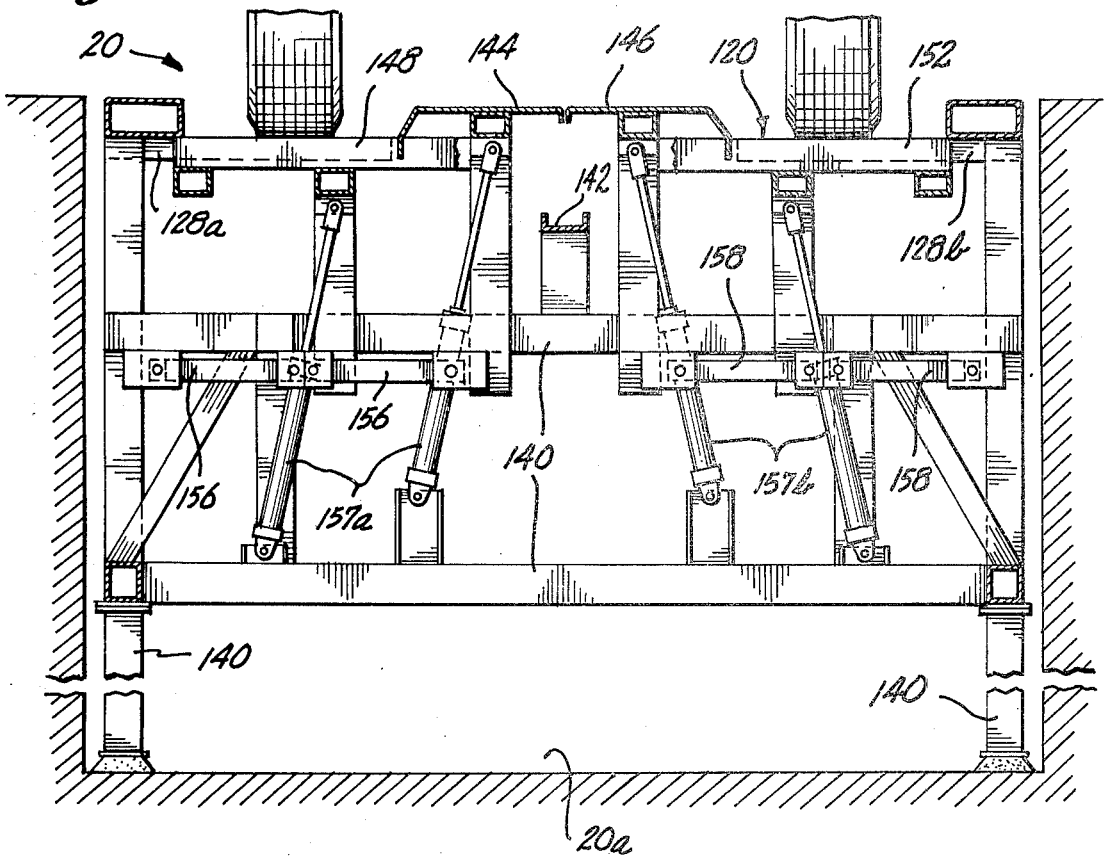
FIG. 5A is a cross-sectional view of the entrance ramp showing the fingers and filler plates in an up position taken along section line 5A—5A of FIG. 5.

As discussed above, the entrance and exit ramps are of substantially identical configuration, but are rotated 180° relative to each other so that an auto can be received with its forward end adjacent the elevator shaft, and vice versa for a vehicle positioned in the exit ramp. Referring first to FIGS. 5 and 5A, the nominal floor level 120 of the entrance ramp 20 is at a ground level. Thus vehicles entering the entrance ramp 20 drive from the exterior of the building at ground level onto the floor of the entrance ramp at the nominal floor level 120. The floor of the entrance ramp is comprised of stationary segments 122*a* and *b*, 124*a* and *b*, and 126*a* and *b*. The segments 122*a*, 124*a* and 126*a* are situated on one side of the entrance ramp while the segments 122*b*, 124*b* and 126*b* are situated on the opposite side. The "a" portions of the segments are spaced from the "b" portions of the segments thus leaving a central portion of the stationary part of the floor open. Interposed in parallel relationship between the segments 122*a* and 124*a* and between the segments 122*b* and 124*b* are front wheel support fingers 128*a* and 128*b*. These fingers are spaced in parallel relationship and extend inwardly from the edges of the stationary portion of the entrance stall. The inner ends of the fingers 128*a* and 128*b* are also spaced by the same distance as the inner edges of the stationary plate members 122*a* and 122*b* for example. Similarly, spaced between the segments 124 and 126 are rear wheel support fingers 130*a* and 130*b*. These fingers, again, are similarly spaced in parallel relationship and similarly have their inner ends spaced by the same distance as the plate segments 124 and 126. All of the plate segments 122, 124, 126 and fingers 128 and 130 are supported by a subframe 140, resting on the floor of a pit 20*a*. The subframe 140 also supports the guide rail 142, which is situated below the plates 122, 124, and 126 and the fingers 128 and 130. The guide rail 74 on the turntable is alignable with the guide rail 142 when the turntable is positioned to receive a vehicle from the entrance ramp. Thus the guide rail 142 serves to guide the shuttle as it traverses into and out of the entrance ramp.

Figure 6:
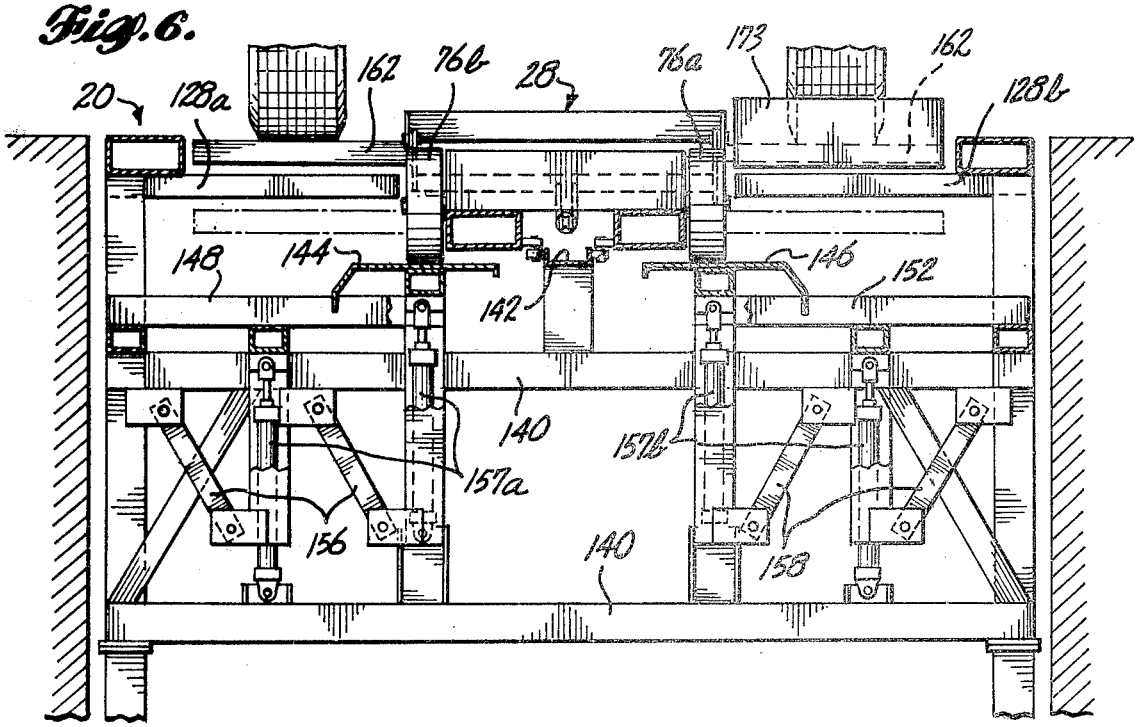
FIG. 6 is a cross-sectional view taken along section line 6—6 of FIG. 4 showing the filler plate end fingers in a down position and the shuttle positioned in the ramp and lifting the vehicle above the ramp.

Although the stationary plates 122, 124, and 126 and the fingers 128 and 130 are adequate to support a vehicle when it is positioned in the entrance stall, it is desirable to have a substantially continuous floor under the vehicle when the occupants of the vehicle are exiting from the vehicle and the building. Thus, as illustrated in FIGS. 5 and 5A a pair of filler assemblies are provided. The filler assemblies comprise central longitudinal plates 144 and 146. Affixed to one plate 144 are front wheel fingers 148 and rear wheel fingers 150. Similarly attached to the other plate 146 are front wheel fingers 152 and rear wheel fingers 154. The plates 144 and 146 are mounted on the frame 140 for upward and downward swinging movement via parallel links 156 for the plate 144 and parallel links 158 for plate 146. Linearly extensible hydraulic cylinder units 157*a* and 157*b* power the plates 144 and 146 and associated hardware between the upward and downward positions. The plates 144 and 146 when in their upward position fill in the space between the plates 122*a* through 130*a* and plates 122*b* through 126*b*, respectively. Furthermore, the fingers 148 and 150 interdigitate with the fingers 128*a* and 130*a*, while the fingers 152 and 154 interdigitate respectively with the fingers 128*b* and 130*b*. When the plates 144 and 146 in their lower position, as shown in FIG. 6, the plates 144 and 146 lie on opposite sides of and slightly below the level of the entrance ramp guide rail 142. Thus, the longitudinal plates 144 and 146 serve as runways for the wheels 78*a* and *b* and 76*a* and *b* of the shuttle as it traverses into the entrance ramp 20 under the stationary plates 122, 124, and 126, and the stationary fingers 128 and 130.

Figure 4:
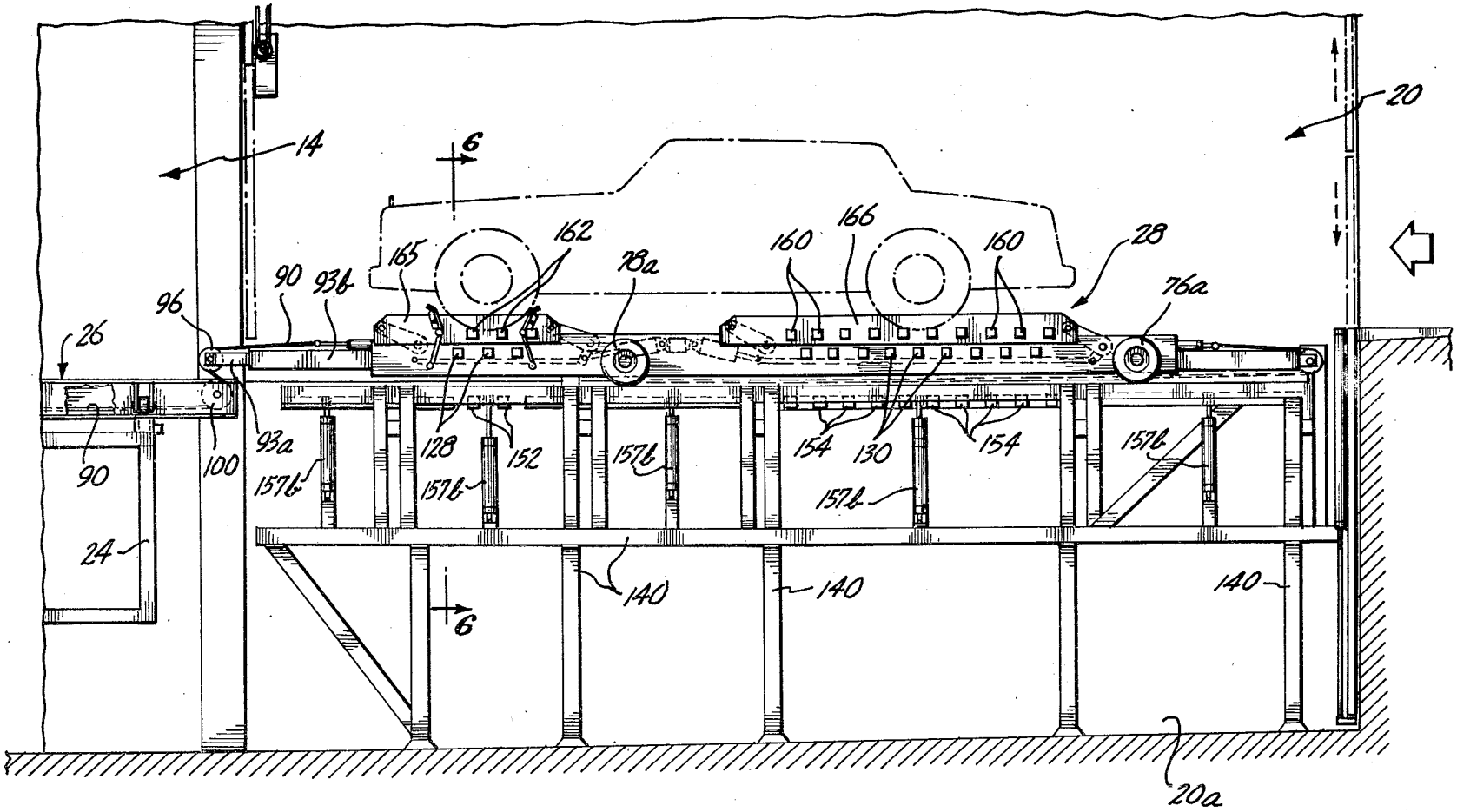
FIG. 4 is a vertical sectional view of the entrance ramp showing the shuttle lifting a vehicle and poised for return to the turntable.

Referring now to FIGS. 3A, 4, 7 and 7A, the shuttle 28 also carries a set of rear wheel support fingers 160 and a plurality of front wheel support fingers 162. The rear wheel support fingers 160 are mounted for upward and downward movement by a plurality of parallel links 164 each of which have one end mounted to a finger frame assembly 166 and the other end mounted to the shuttle frame 28*a* all for rotation about parallel axes. By rotating the parallel links 164 about their connection points to the shuttle frame 28*a*, the rear wheel support fingers 166 are swung upwardly and downwardly from a position on top of the shuttle to a position as shown in FIGS. 4 and 7A above the stationary fingers 130*a* and 130*b* in the entrance ramp. Similarly, the front wheel support fingers 162 are supported by parallel links 168 in turn pivotally mounted between the shuttle frame 28*a* and the front finger frame assembly 165. Hydraulic piston and cylinder assemblies 170 and 172 are coupled between the frame 28*a* and arms 164*a* and 168*a* in turn coupled to torque tubes 167 and 169 in turn respectively coupled to the links 164 and 168 for powering the links to raise and lower the respective front and rear wheel fingers 162 and 160. As best seen in FIGS. 3A and 7, the several links 164 are coupled for simultaneous movement by a link 164*b* connecting arms 164*a*. Similarly, the links 168 are interconnected by a connecting link 168*b* coupled to the arms 168*a*. Additionally the adjacent arms 168*a* and 164*a* are interconnected by link 71 so that the front and rear wheel frames 165 and 166 are raised and lowered simultaneously.

Additionally, the front wheel frame 165 assembly also carries a pair of front wheel stop plates 173 spaced longitudinally relative to the shuttle frame 28*a*. The plates are pivoted on the frame 165 for pivotal movement about axes that are transverse to, and preferably orthogonal to the longitudinal dimension of the shuttle frame. The stop plates flank the front wheel support fingers 162 and are coupled to the shuttle frame 28*a* by links 175. Thus as the front finger frame 165 is raised, the plates are caused to rotate from a horizontal position (See FIG. 3) to a raised position as shown in FIG. 3A. In this manner the plates 173 function as stop blocks for the front wheel of a vehicle to prevent it from inadvertently rolling off the shuttle.

As can be seen in FIG. 4, the shuttle is so positioned under the stationary portion of the entrance ramp 20 and the shuttle fingers 162 and 166 are so positioned that when the shuttle fingers 162 and 166 are raised, they interdigitate and pass through the stationary fingers 128*a* and *b* and 130*a* and *b* on the stationary portion of the ramp. Thus, as the shuttle fingers pass between the stationary fingers, they contact the tires of the vehicle resting on the stationary fingers and raise it above the level of the entrance ramp. The shuttle is then free to return to the turntable 26 where it is rotated and elevated to an appropriate position so that shuttle can by reverse action move the vehicle to an available parking stall.

Figure 2A:
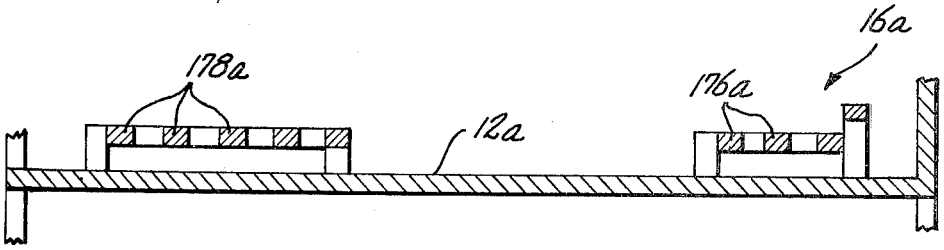
FIG. 2A is an enlarged vertical sectional view of one of the parking stalls in the tower.
Figure 2:
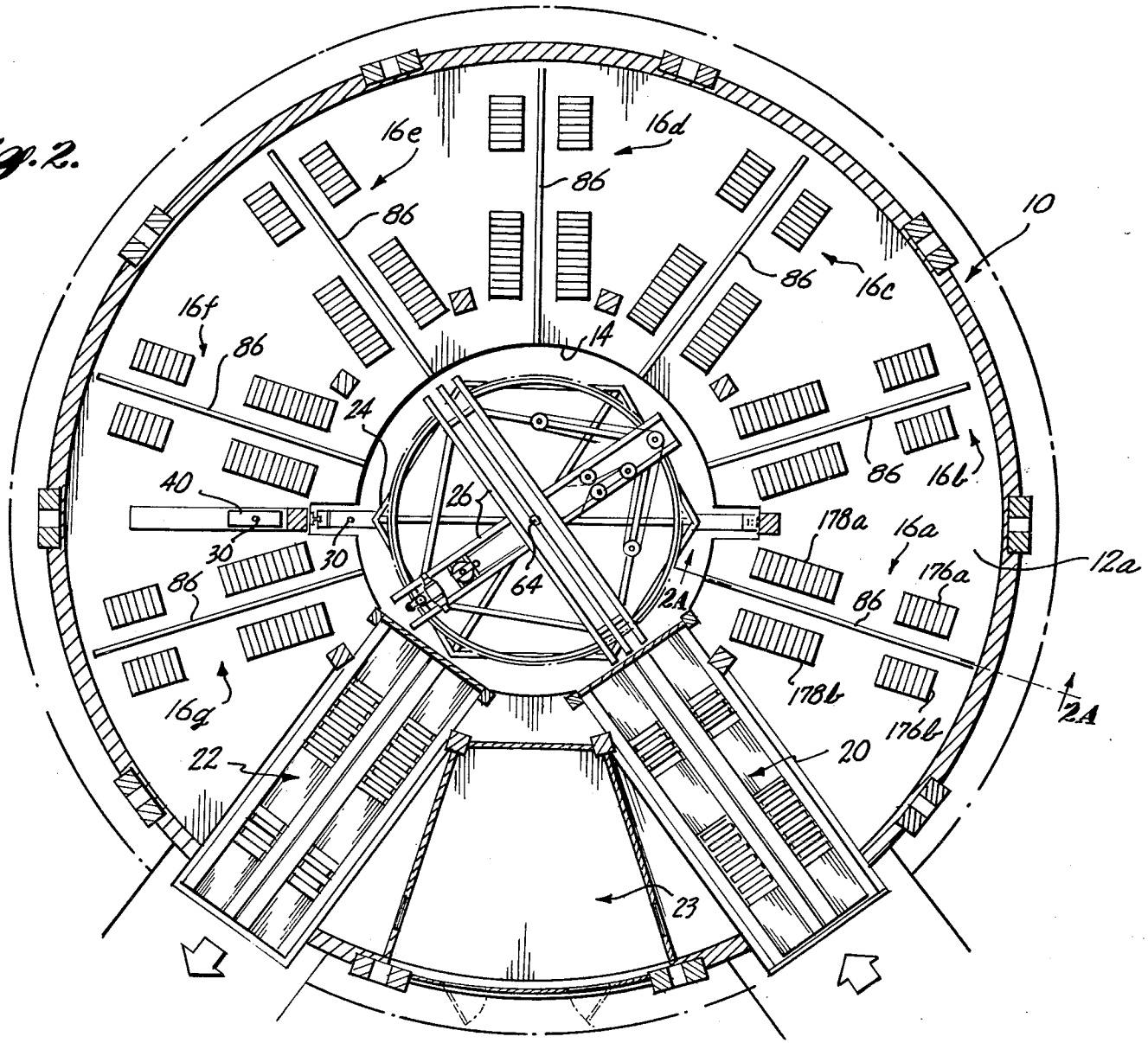
FIG. 2 is a cross-sectional view of the parking tower taken along a section line similar to 2—2 of FIG. 1.

As noted in FIG. 2A, each parking stall has four sets of vehicle support fingers, two front wheel sets 176*a* and *b* and two rear wheel sets 178*a* and *b*. These support fingers are elevated above the floor by an appropriate support frame. As the shuttle moves into the parking stalls, the shuttle fingers 162 and 166 are elevated above the stall fingers 176 and 178. The shuttle fingers 160 and 162 are then lowered so that the vehicle is deposited on the parking stall fingers 176 and 178. Again, the parking stall fingers are spaced and arranged so that the shuttle fingers will interdigitate with the parking stall fingers when the vehicle is being deposited on the parking stall fingers.

Referring now back to FIG. 7 and 7A, it will be recognized that the shuttle 28 must carry hydraulic equipment for one, extending and retracting the extensible end sections 93 and 94, and for raising and lowering the shuttle fingers 160 and 162. Thus it is necessary to provide hydraulic fluid to the shuttle not only when it is positioned on the turntable but necessarily when it is positioned off the turntable in the entrance ramp, the exit ramp or a parking stall. As hydraulic fluid is normally supplied to hydraulic cylinders such as are utilized for power on the shuttle 28, it becomes necessary to feed, properly tension, and retrieve hydraulic lines from the shuttle. This is accomplished by a unique system of guide and reciprocating and counterweighted pulleys. Referring first to FIG. 7, it will be noted that a typical hydraulic line 180 extends laterally from the shuttle 28. A funnel shaped member 182 allows the hydraulic line to extend forwardly from the shuttle without abrasive interference with a portion of the shuttle and be swung 180 degrees so that it can also extend rearwardly from the shuttle. The hydraulic line 180 extends outwardly from the shuttle toward the edge of the turntable. Between the center and edge of the turntable, two pairs of spaced sheaves, 184 and 186 are fixed in spaced relationship between the turntable frame members 54. The sheaves 184 and 186 are spaced in a longitudinal direction of travel of the shuttle and are mounted for rotation in a substantially horizontal plane. The hydraulic line 180 extends between the sheaves and outwardly to a second sheave 188 spaced radially outwardly from sheave 186 relative to the turntable 26.

Additional sheaves 190 and 192 are mounted on angle frame 191 and 193 extending at 45 degree angles between the outer ends of adjacent rails 54 and 52 on the same side of the shuttle guide track 90 as are positioned sheaves 184 and 186. The support 192*a* for sheave 192 is mounted in a slot 193*a* for reciprocation along a substantially linear path that is oriented at an angle of approximately 45 degrees to each of the rails 52 and 54. A cable 194 is affixed to sheave 192, runs through pulleys 196 and is connected to a counterweight 198. Thus the sheave 192 is biased in a direction away from the edge portion of the turntable 26 spaced laterally outwardly from the position where the hydraulic line extends from the shuttle. The sheave 190 is similarly mounted for reciprocation in a slot 191*a* and is biased by a similar counterweight assembly including cable 200, pulley 202, and counterweight 204.

After the hydraulic line 180 traverses sheave 188 it extends toward sheave 192, wraps around it 180 degrees and extends back toward and engages a sixth sheave 206 located on the turntable outboard from the sheaves 184, 186, and 188. After wrapping 90 degrees around sheave 206 the hydraulic line extends to sheave 192, is wrapped 180 degrees around sheave 192 and extends back to one of the frames 54 where it is affixed to a stationary hydraulic supply line. When the shuttle is positioned in the center of the turntable, the sheaves 190 and 192 are biased away from the sixth sheave 206 at the periphery of the turntable. As the shuttle moves in either direction from the turntable, hydraulic line is fed out between the sheaves 184 and 186. Proper tension is maintained on the line by the counterweights 198 and 204, which allow the sheaves 192 and 190 to move outwardly toward the sheave 206. As the shuttle returns to the center of the turntable, the counterweights 198 and 204 pull the sheaves 192 and 190 away from the sheave 206 thus again maintaining proper tension on the hydraulic line and retrieving it between the paired sheaves 184 and 186.

The present invention has been described in relation to a preferred embodiment. One of ordinary skill after reading the foregoing specification will be able to effect various changes, substitutions of equivalents, and other alterations without departing from the general concept disclosed herein. It is therefore intended that the scope of Letters Patent granted hereon be limited only by the definition contained in the appended claims and equivalents thereof.

The embodiments of the invention in which an exclusive property or privilege is claimed are defined as follows:

1. A shuttle assembly for an automated parking system comprising:

vehicle transfer means for carrying a vehicle from adjacent a first vehicle-receiving stall to adjacent a second vehicle-receiving stall, shuttle means associated with said vehicle transfer means and said vehicle-receiving stalls for transferring a vehicle between said vehicle transfer means and said stalls, said shuttle means reciprocating along a substantially linear path between said vehicle transfer means and said stalls, said shuttle means having first and second ends, said vehicle transfer means having first and second ends adjacent the first and second ends of said shuttle means when said shuttle means is situated on said vehicle transfer means, said vehicle transfer means having a first sheave means mounted adjacent the first end thereof, a second sheave means and first extensible means mounting said second sheave means on the second end of said shuttle means, a drum and motor means for selectively and reversibly rotating said drum mounted on said vehicle transfer means, a first flexible member affixed to and extending from adjacent the second end of said shuttle means toward the second end of said vehicle transfer means, engaging said second sheave means, extending toward and engaging the first sheave means, and extending toward and wrapped about said drum, said first extensible means capable of selectively increasing and decreasing the distance between said second sheave means and said shuttle means to thereby extend the travel of said shuttle means into said stalls in the direction of reciprocation thereof.

2. The shuttle assembly of claim 1 further comprising:

a third sheave means mounted on the second end of said vehicle transfer means, a fourth sheave means and second extensible means mounting said fourth sheave means adjacent the first end of said shuttle means, a second flexible member affixed to and extending from adjacent the first end of said shuttle means engaging the fourth sheave means, extending toward and engaging the third sheave means, and extending toward and wrapped about said drum in the opposite direction from said first flexible member, said second extensible means capable of selectively increasing and decreasing the distance between the fourth sheave means and said shuttle means to thereby extend the travel of said shuttle means into the stalls in the direction of reciprocation.

3. The shuttle assembly of claim 2 wherein each of said extensible means comprises a hydraulic piston and cylinder assembly coupled between the shuttle means and a respective second or fourth sheave means, said piston and cylinder assembly being capable of linear extension in the direction of reciprocation of said shuttle means.

* * * * *